US008217739B2

(12) United States Patent
Wu

(10) Patent No.: US 8,217,739 B2
(45) Date of Patent: Jul. 10, 2012

(54) MICRO SWITCH

(75) Inventor: Jui-hsiung Wu, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 107 days.

(21) Appl. No.: 12/961,496

(22) Filed: Dec. 7, 2010

(65) Prior Publication Data

US 2012/0139674 A1 Jun. 7, 2012

(51) Int. Cl.
*H01H 51/22* (2006.01)

(52) U.S. Cl. ..... 335/78

(58) Field of Classification Search ..... 335/78, 335/132

See application file for complete search history.

(56) References Cited

U.S. PATENT DOCUMENTS 3,766,501 A * 10/1973 Hotte et al. ..... 335/190
5,886,641 A * 3/1999 Ulerich et al. ..... 340/638
6,433,290 B1 * 8/2002 Ulerich et al. ..... 200/308
7,732,723 B2 * 6/2010 Kolmonen et al. ..... 200/534
2003/0048161 A1 * 3/2003 Johnson et al. ..... 335/132

* cited by examiner

*Primary Examiner* — Elvin G Enad
*Assistant Examiner* — Alexander Talpalatskiy
(74) *Attorney, Agent, or Firm* — Cheng-Ju Chiang

(57) ABSTRACT

A micro switch is disclosed and includes a bracket, at least one conductive terminal assembly, a push rod and an electromagnet. The conductive terminal assembly has a first terminal, an elastically conductive plate, a spring and a second terminal. A first end of the spring is hooked on the first terminal, and a second end thereof is hooked on the elastically conductive plate. The push rod is slidably installed on the bracket, and has a recess, a sliding inclined surface and a top flat surface. The push rod can be slid to cause the spring to slide into the recess and onto the top flat surface. Thus, the spring can actuate the elastically conductive plate to pivotally rotate and abut against the second terminal. Thus, the structure of the micro switch is simplified and the installation thereof is easier.

8 Claims, 12 Drawing Sheets

MICRO SWITCH

FIELD OF THE INVENTION

The present invention relates to a micro switch, and more particularly to a micro switch having simple structures including a push rod used to directly control switch operations.

BACKGROUND OF THE INVENTION

Referring now to FIGS. 10, 11 and 12, a traditional micro switch 100' is illustrated. As shown, the traditional micro switch 100' comprises a coil 1', an armature 2', a release spring 3', a return button 4', a return spring 5', a brake plate 6', a balance frame 7', a contact switch 8' and a pull rod 9', wherein the pull rod 9' is a metal cylinder combined with the return button 4' by hot casting. A lower end of the pull rod 9' has a flange 91' which has an upper surface 911' and a lower surface 912'. The brake plate 6' has a first lock hole 61' and a second lock hole 62', wherein the first lock hole 61' has a right vertical surface 611' and a left curved surface 612'. The balance frame 7' has a first opening 71' and a second opening 72' formed along a longitudinal axis and a horizontal axis thereof, respectively. The pull rod 9' is movably shifted upward and downward in the first opening 71' along the longitudinal axis of the balance frame 7'. A portion of the brake plate 6' having the first lock hole 61' can be extended into the second opening 72' and moved leftward and rightward.

When the traditional micro switch 100' is in a release status, the left curved surface 612' of the first lock hole 61' of the brake plate 6' is tightly abutted against a cone on the lower end of the pull rod 9' due to an elastic return force of the release spring 3'. The lower end of the pull rod 9' has the flange 91', so that the return button 4' can not be returned when the coil 1' is not energized. During switching on the traditional micro switch 100', the coil 1', the armature 2', the release spring 3', the return button 4', the return spring 5', the brake plate 6', the balance frame 7', the contact switch 8' and the pull rod 9' must commonly coordinate with each other to move the balance frame 7' upward. Then, the balance frame 7' actuates a dynamic contact plate (not-shown) to move upward to be in contact with a static contact plate (not-shown), so as to finish switching on the traditional micro switch 100'.

However, the structure of the traditional micro switch 100' is too complicated, and thus the installation thereof is difficult. To solve the shortcoming of the traditional micro switch 100', the present invention designs a micro switch having simpler structures which thus can be conveniently installed.

SUMMARY OF THE INVENTION

A primary object of the present invention is to provide a micro switch having simple structures including a push rod used to directly control switch operations, so as to enhance the manufacture efficiency of the mold assembly.

To achieve the above object, a micro switch of a preferred embodiment of the present invention comprises: a bracket; at least one conductive terminal assembly substantially disposed in the bracket and having a first terminal, a conductive plate, a spring and a second terminal, one end of the spring being hooked on the first terminal, and the other end thereof being hooked on the conductive plate, one side end of the conductive plate being pivotally engaged to the first terminal; a push rod slidably disposed in the bracket substantially and straddled by the at least one conductive terminal assembly, the push rod having a recess and a top flat portion next to the recess on a side surface thereof, wherein a side wall of the recess adjacent to the top flat portion is formed as a inclined surface; and an electro-magnet disposed in the bracket next to the at least one conductive terminal assembly and having a coil and an armature, wherein one end of the armature is connected to one end of the push rod; wherein when being positioned in the recess, the spring is in an unforced state, so as to disconnect the conductive plate from the second terminal; alternatively, the push rod is pushed toward the electro-magnet to make the spring slide along the inclined surface to the top flat portion, and the spring is abutted against the top flat portion to deform, so as to make the conductive plate rotate toward and in contact with the second terminal.

In one embodiment of the present invention, the first terminal has an inclined connection base, one side end of the connection base projects outward and bends vertically to form two spaced retaining portions for retaining the push rod, wherein each of the retaining portions further has a horizontal retaining portion and a vertical retaining portion, the vertical retaining portion is formed with a pivotal groove for engaging with said one side end of the conductive plate, the connection base has a hook protrusion, while the conductive plate has a hook slot, said one end of the spring is hooked on the hook protrusion, and said the other end thereof is hooked on the hook slot.

In one embodiment of the present invention, the armature and the push rod are connected to each other by a connection member.

In one embodiment of the present invention, the connection member is substantially U-shaped, and the connection member has a base and two blocking walls projecting upward from two opposite sides of the base, wherein a top portion of each of the blocking wall has an indentation, said one end of the armature and said one end of the push rod are partially thinned to fit into the two indentations respectively so as to abut against each other.

In one embodiment of the present invention, the first terminal is placed on one side of the push rod, while the conductive plate and the second terminal are placed on the other opposite side of the push rod.

In one embodiment of the present invention, the inclined surface of the recess is formed on the side wall of the recess at a longer distance away from the electro-magnet than the other side wall of the recess.

In one embodiment of the present invention, the bracket comprises a terminal assembly receiving housing and a base, wherein the at least one conductive terminal assembly is disposed in the terminal assembly receiving housing, and the push rod is movably received in the terminal assembly receiving housing.

In one embodiment of the present invention, the terminal assembly receiving housing comprises a lower hollow casing, a base hollow casing and an upper hollow casing successively joined together, the base has a receiving recess and a frame, wherein the electro-magnet is installed in the receiving recess, and the terminal assembly receiving housing is installed within the frame.

As described above, the micro switch of the present invention simplifies switch components into three parts, i.e. the conductive terminal assembly, the push rod and the electro-magnet, while the push rod can be directly pushed to switch on or off the micro switch, so that the structure of the micro switch is simplified and the installation thereof is easier.

DETAILED DESCRIPTION OF THE PREFERRED EMBODIMENTS

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

Figure 1:
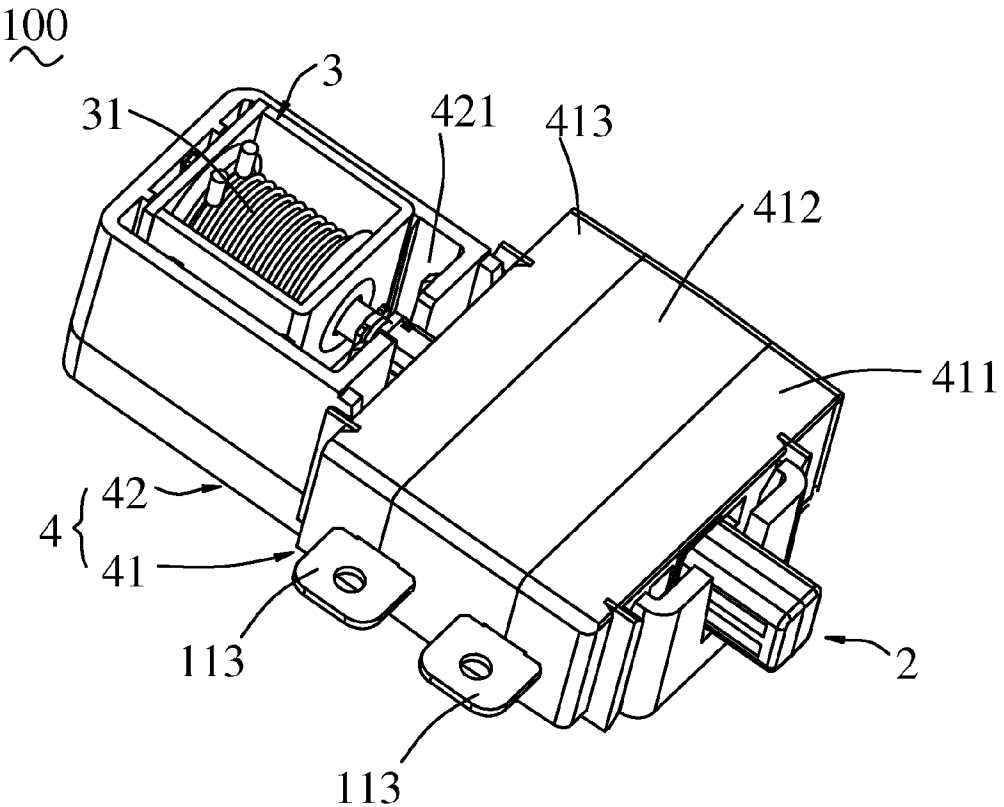
FIG. 1 is an assembled perspective view of a micro switch according to a preferred embodiment of the present invention.
Figure 2:
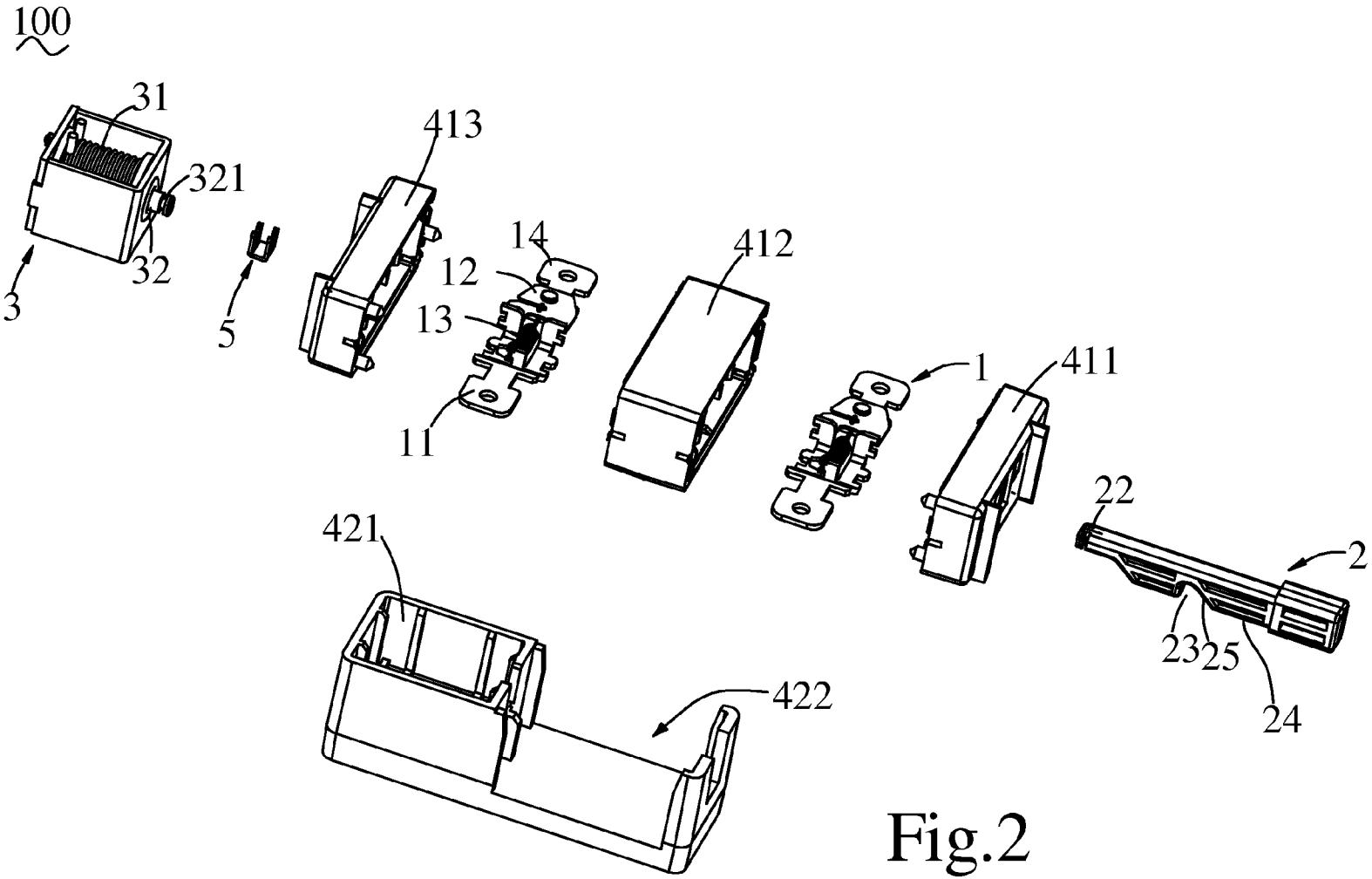
FIG. 2 is an exploded perspective view of the micro switch according to the preferred embodiment of the present invention.

Referring now to FIGS. 1 and 2, a micro switch according to a preferred embodiment of the present invention is illustrated. As shown, a micro switch 100 comprises two conductive terminal assemblies 1, a push rod 2 and an electro-magnet 3 and a bracket 4.

Figure 3:
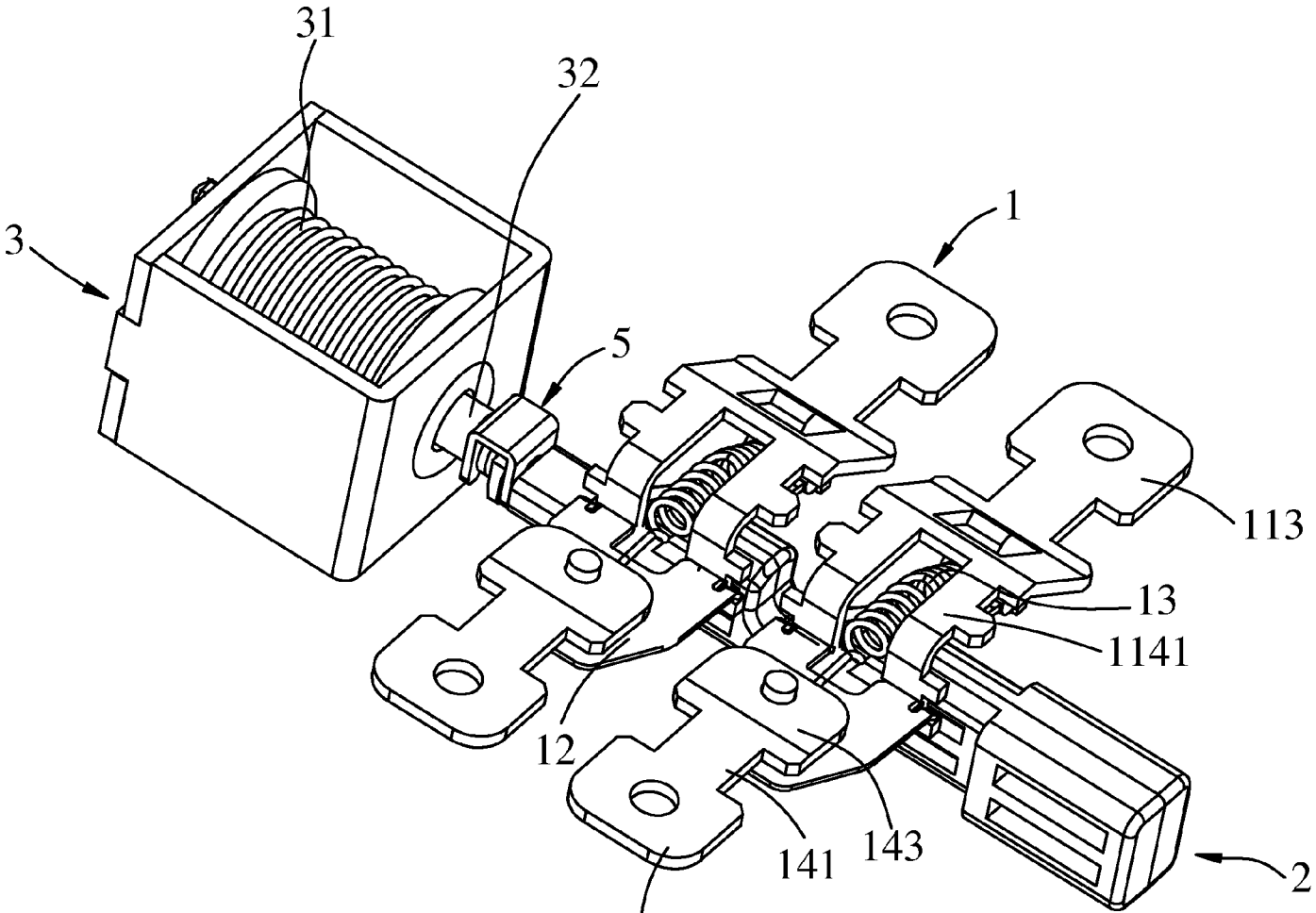
FIG. 3 is an assembled perspective front view of conductive terminal assemblies, a push rod, an electro-magnet and a connection member of the micro switch according to the preferred embodiment of the present invention.
Figure 4:
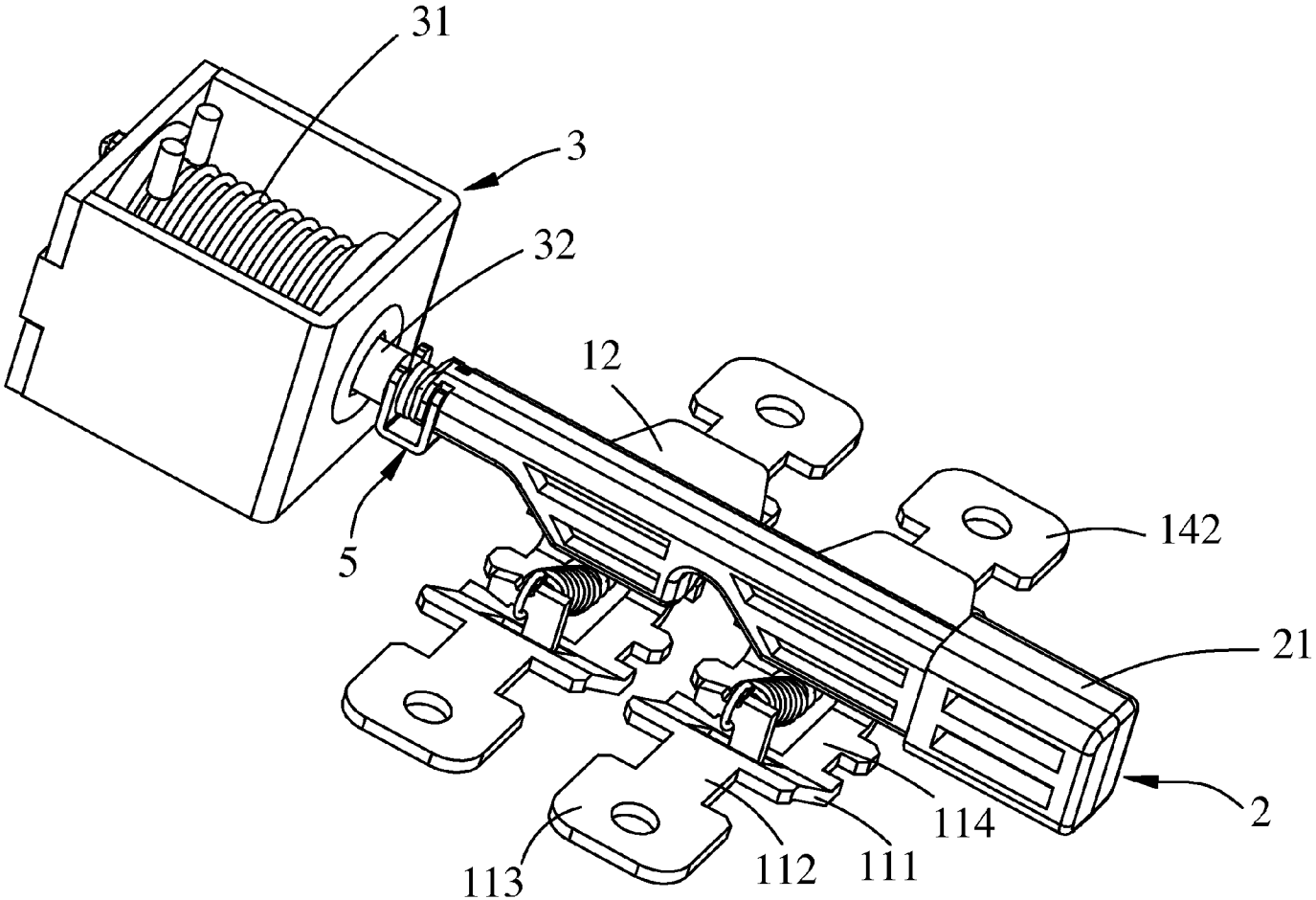
FIG. 4 is another assembled perspective rear view of the conductive terminal assemblies, the push rod, the electro-magnet and the connection member of the micro switch according to the preferred embodiment of the present invention, seen from another viewing angle.

Referring now to FIGS. 2, 3 and 4, each of the two conductive terminal assemblies 1 comprises a first terminal 11, an elastically conductive plate 12, a spring 13 and a second terminal 14. The first terminal 11 and the second terminal 13 are fixed on the bracket 4.

Figure 6:
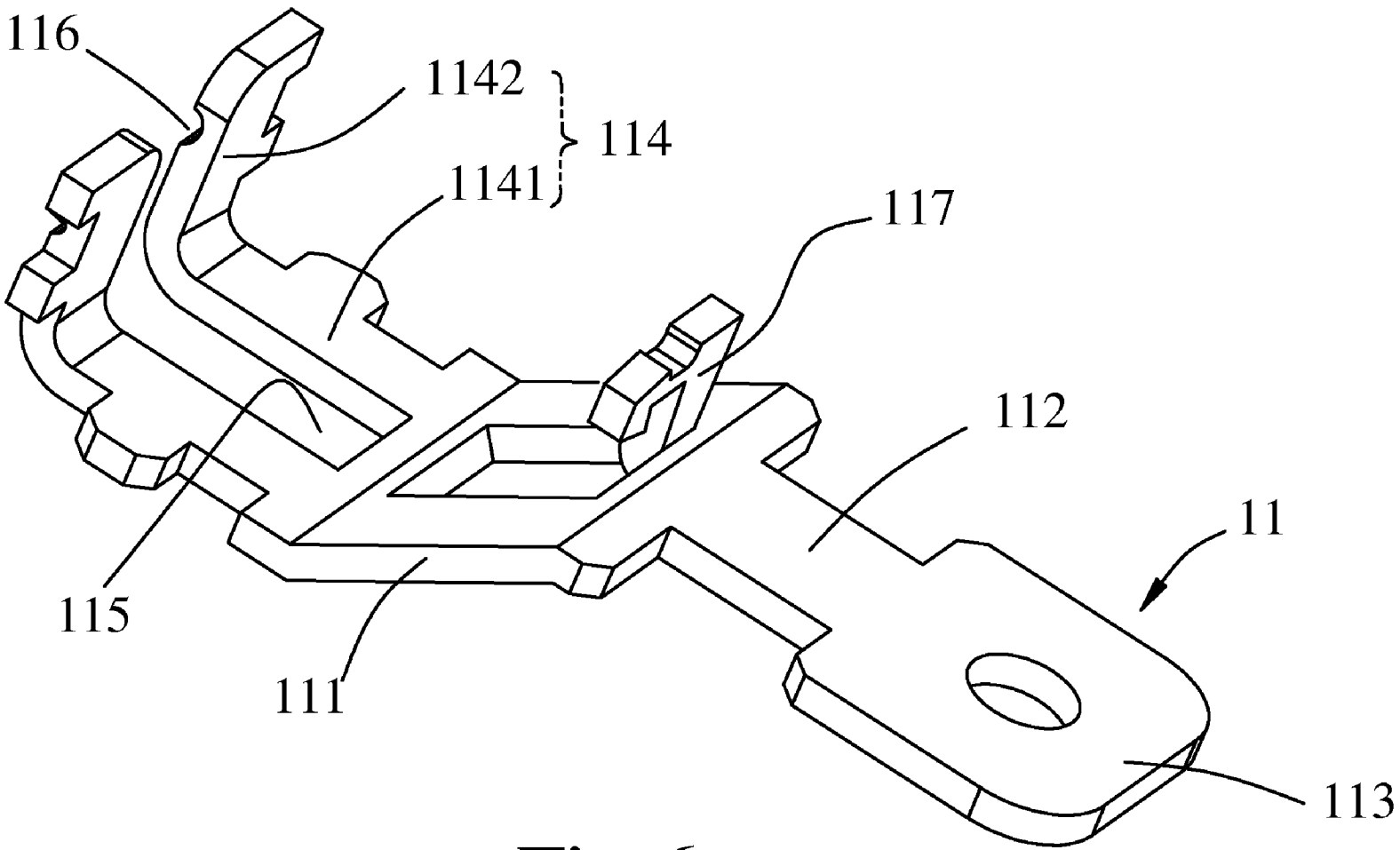
FIG. 6 is a perspective view of a first terminal of the micro switch according to the preferred embodiment of the present invention.
Figure 7:
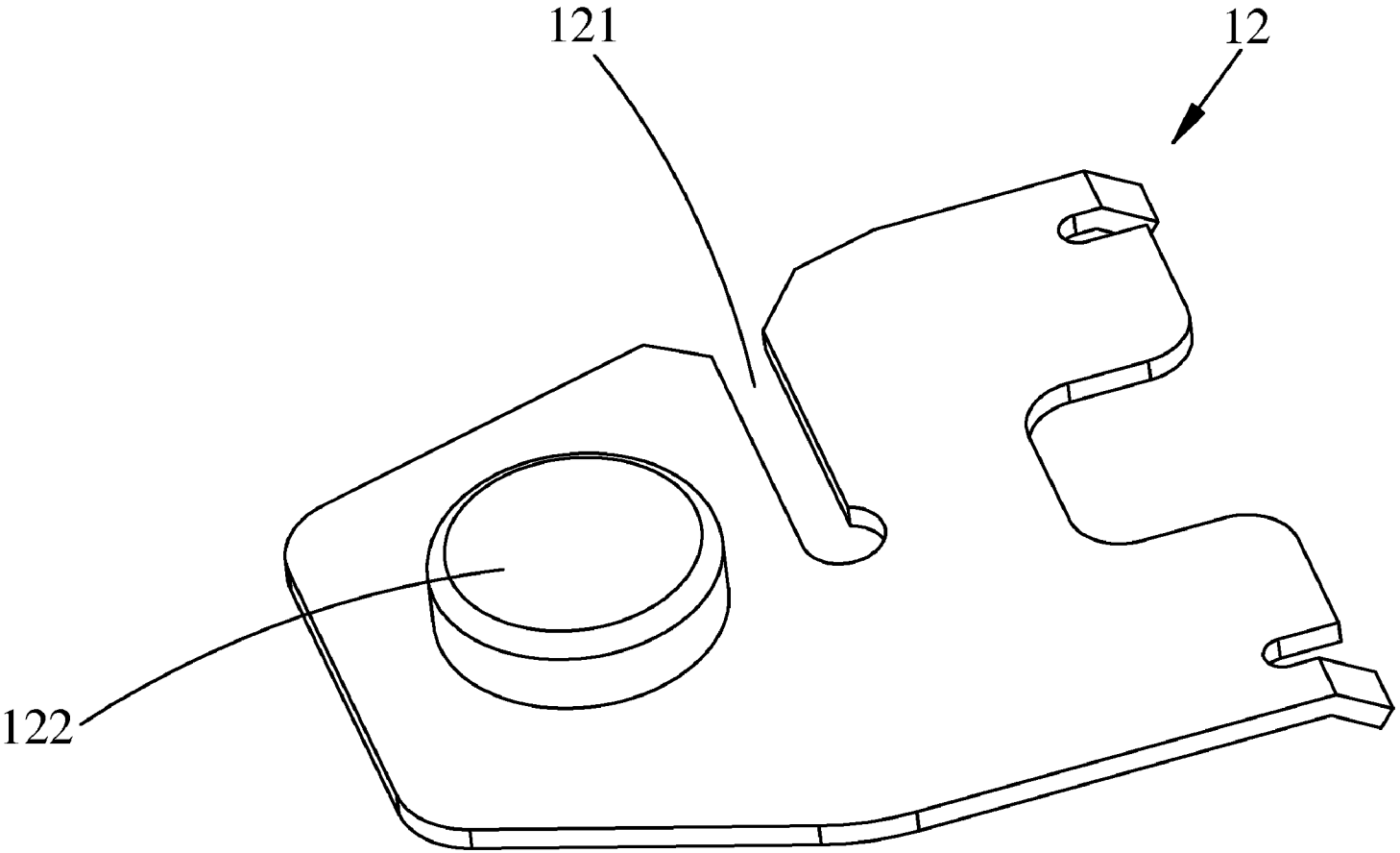
FIG. 7 is a perspective view of an elastically conductive plate of the micro switch according to the preferred embodiment of the present invention.

Referring now to FIG. 6, the first terminal 11 has an inclined connection base 111, wherein a first end of the connection base 111 has a central portion projected to form a first insertion portion 112 which continues to project to form a first terminal portion 113. The first terminal portion 113 is used to be electrically connected to an electrical connection component (not-shown). Furthermore, a second end of the connection base 111 has a side edge projected and vertically bent to form two retaining portions 114, wherein the two retaining portions 114 and the connection base 111 commonly define a retaining indentation 115. Each of the retaining portions 114 further has a horizontal retaining portion 1141 and a vertical retaining portion 1142. The vertical retaining portion 1142 is formed with a pivotal groove 116. One side portion of the connection base 111 close to the first insertion portion 112 is formed with a hook protrusion 117, wherein the spring 13 is hooked on the hook protrusion 117.

Referring to FIGS. 2, 3, 4, and 7, the elastically conductive plate 12 is substantially a trapezoidal plate, and a central portion of the elastically conductive plate 12 is formed with a hook slot 121. Moreover, a side edge of the elastically conductive plate 12 is installed in the pivotal groove 116 of the first terminal 11. For conveniently describing, the side edge of the elastically conductive plate 12 installed in the pivotal groove 116 of the first terminal 11 is defined as a pivotal side edge, wherein the elastically conductive plate 12 can pivotally rotate based on the pivotal side edge. Besides, the elastically conductive plate 12 is further provided with a contact member 122 which is mounted on the other side edge of the elastically conductive plate 12 opposite to the pivotal side edge.

Figure 8:
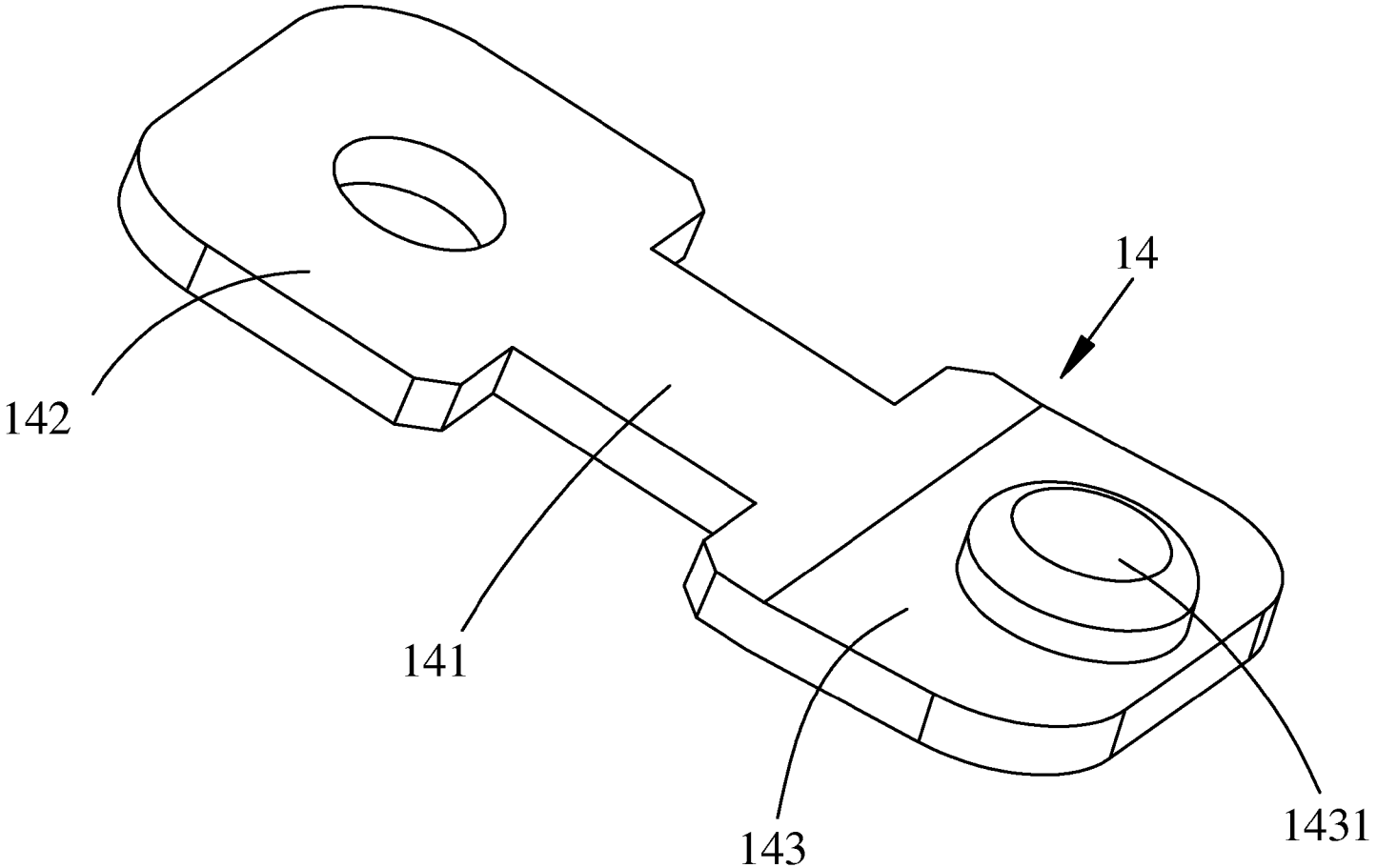
FIG. 8 is a perspective view of a second terminal of the micro switch according to the preferred embodiment of the present invention.

Referring now to FIG. 8, the second terminal 14 has a second insertion portion 141 like a rectangular plate, wherein a first end of the second insertion portion 141 is projected to form a second terminal portion 142, and a second end thereof is projected to form a contact base 143. The second terminal portion 142 is used to be electrically connected to an electrical connection component (not-shown). The contact base 143 is formed with a contact portion 1431.

Figure 5:
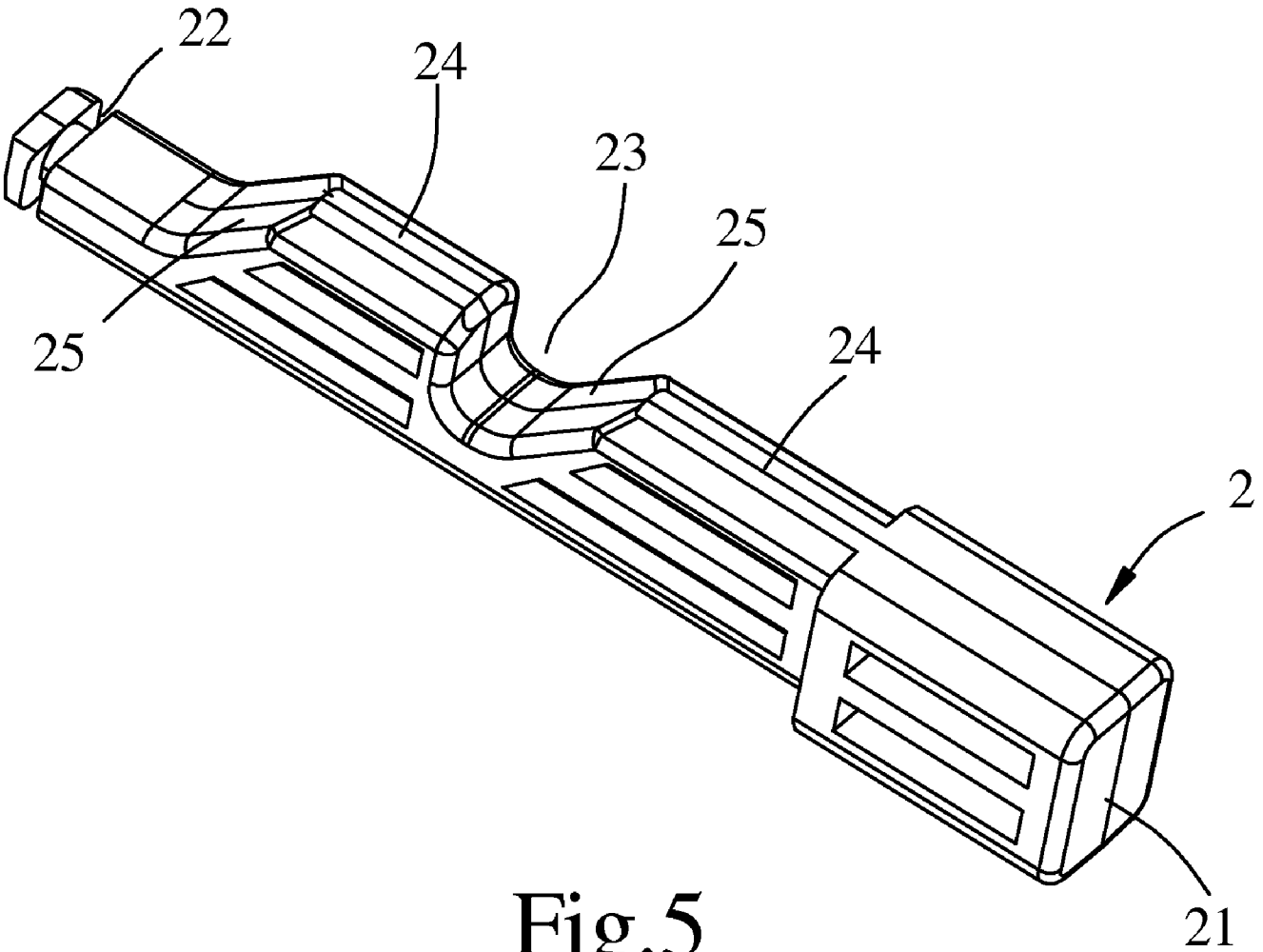
FIG. 5 is a perspective view of the push rod of the micro switch according to the preferred embodiment of the present invention.

Referring now to FIGS. 1, 2 and 5, the push rod 2 is substantially a straight rod, wherein a first end of the push rod 2 is formed with a push portion 21, and an opposite second end thereof is formed with a connection groove 22. The push rod 2 is further formed with two recesses 23 and two top flat surfaces (i.e. abutment surfaces) 24, wherein a side wall of each of the recesses 23 corresponding to the top flat surface 24 is formed with a sliding inclined surface 25. In other words, the sliding inclined surface 25 is formed on the side wall of the recess 23 away from the electro-magnet 3. When the push rod 2 is pushed, the push rod 2 is slid to cause the spring 13 to slide into the recess 23 and onto the top flat surface 24. Thus, the spring 13 can actuate the elastically conductive plate 12 to pivotally rotate and abut against the second terminal 14, so that the micro switch 100 can be switched on.

Referring now to FIGS. 2, 4 and 5, the first terminal 11 is installed on a first side of the push rod 2, and the vertical retaining portion 1142 of the first terminal 11 is abutted against on a rod body of the push rod 2. Meanwhile, the elastically conductive plate 12 and the second terminal 14 are installed on an opposite second side of the push rod 2. A first end of the spring 13 is hooked on the hook protrusion 117 of the first terminal 11, and a second end thereof is hooked on the hook slot 121 of the elastically conductive plate 12. In addition, the pivotal side edge of the elastically conductive plate 12 can pivotally rotate in the pivotal groove 116 of the first terminal 11 about a predetermined angle.

During the spring 13 is slid from the recess 23 onto the top flat surface 24, the first terminal 11 keeps retaining the spring 23 in the retaining indentation 115.

Referring now to FIGS. 1, 2 and 3, the electro-magnet 3 is installed and fixed on the bracket 4, and the electro-magnet 3 has a coil 31 and an armature 32. One end of the armature 32 is formed with an annular connection groove 321, wherein a connection member 5 is used to connect the annular connection groove 321 of the armature 32 to the connection groove 22 of the push rod 2, so that the armature 32 and the push rod 2 can be connected to each other. When the coil 31 of the electro-magnet 3 is energized, the electro-magnet 3 can generate a magnetic force to cause the armature 32 to push the push rod 2 to shift away from the electro-magnet 3.

Referring now to FIGS. 1 and 2, the bracket 4 of the micro switch 100 of the present invention further comprises a terminal assembly receiving housing 41 and a base 42, wherein the conductive terminal assemblies 1 are installed in the terminal assembly receiving housing 41, while the push rod 2 can be movably received in the terminal assembly receiving housing 41. In the embodiment, the terminal assembly receiving housing 41 comprises a lower hollow casing 411, a base hollow casing 412 and an upper hollow casing 413, while the base 42 has a receiving recess 421 and a frame 422. The electro-magnet 3 is installed in the receiving recess 421, and the terminal assembly receiving housing 41 is installed on the frame 422.

Figure 9:
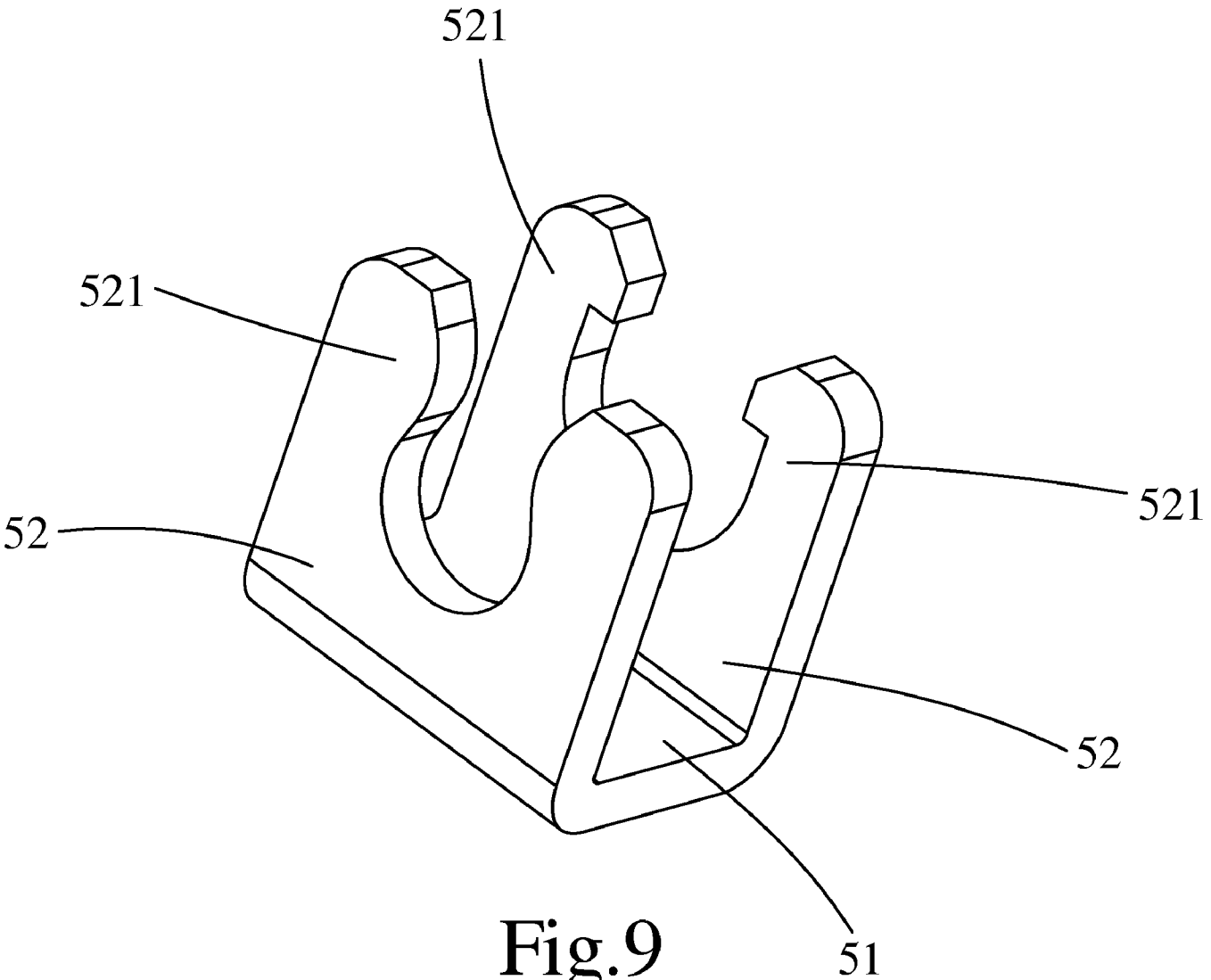
FIG. 9 is a perspective view of a connection member of the micro switch according to the preferred embodiment of the present invention.
Figure 10:
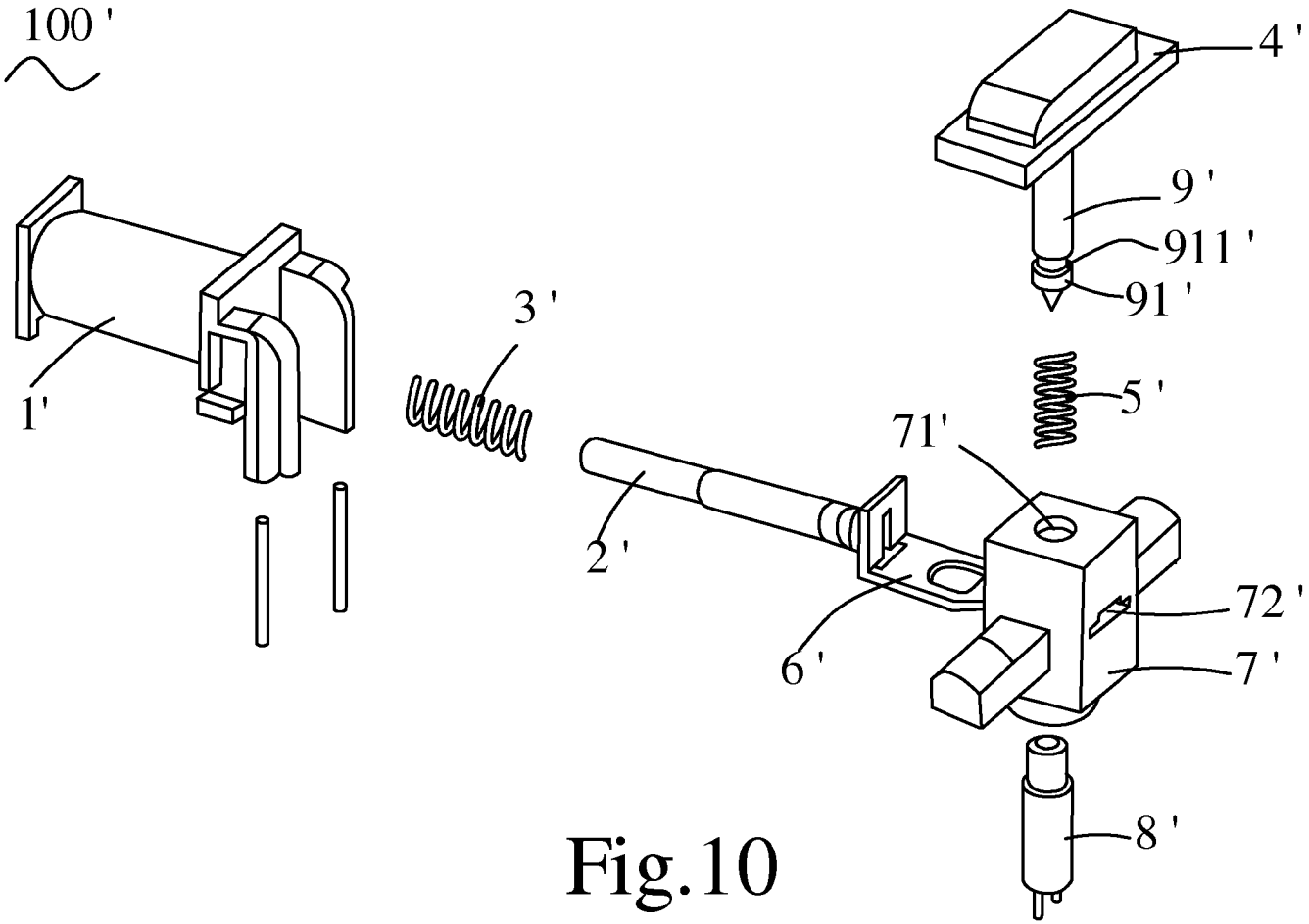
Fig.10 PRIOR ART
FIG. 10 is an exploded perspective view of a traditional micro switch.
Figure 11:
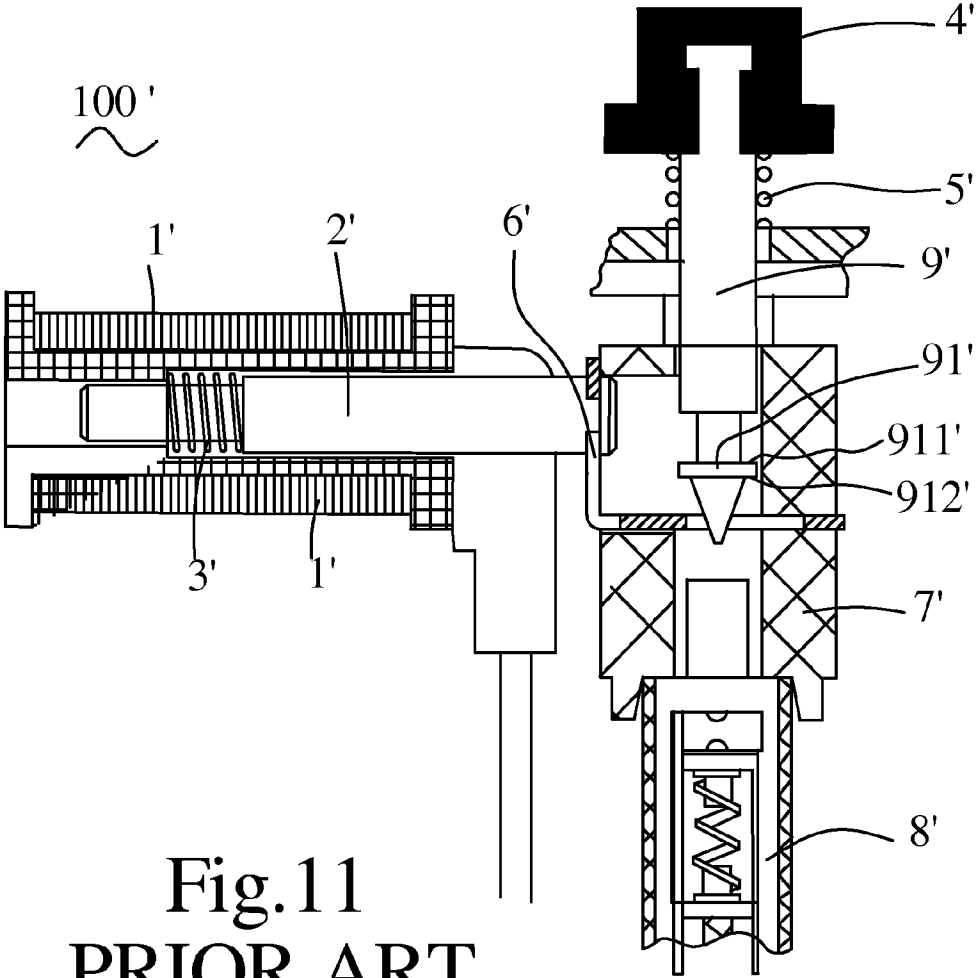
Fig.11 PRIOR ART
FIG. 11 is a cross-sectional view of the traditional micro switch in a release status.
Figure 12:
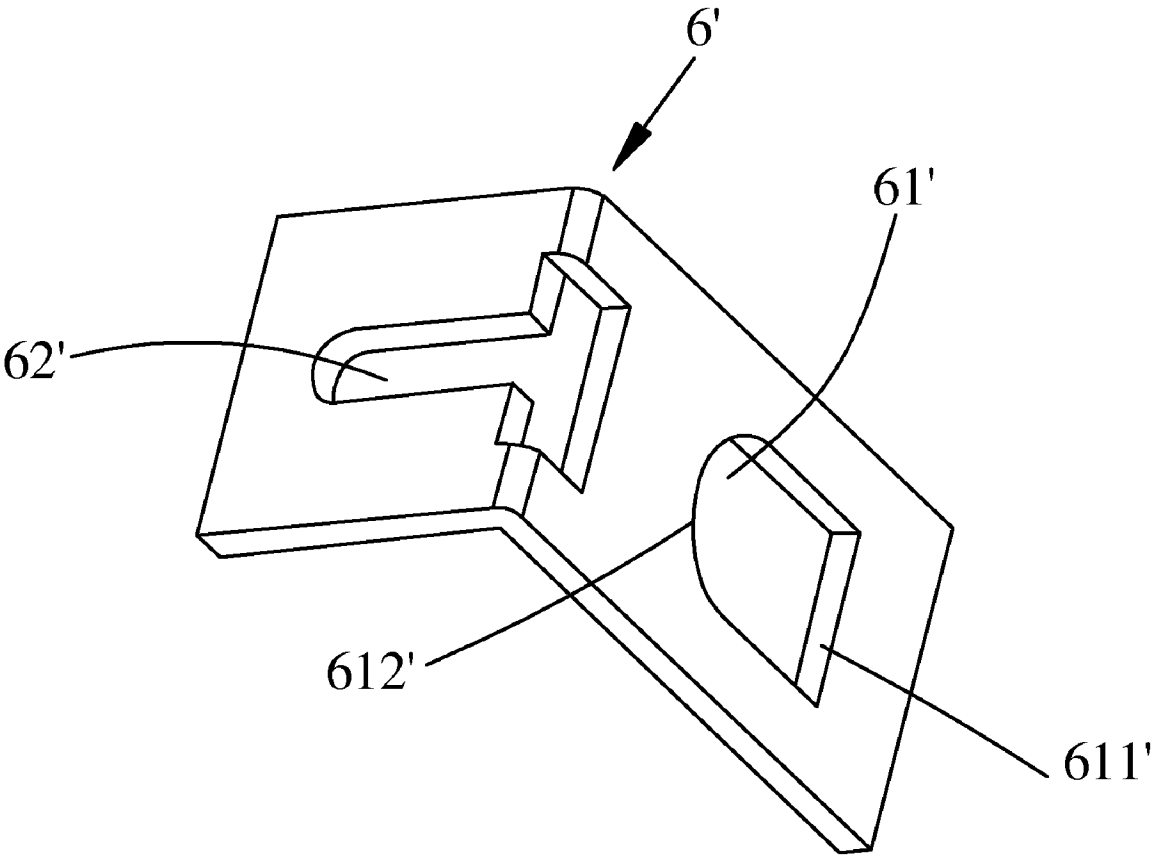
Fig.12 PRIOR ART
FIG. 12 is a perspective view of a brake plate of the traditional micro switch.

Referring now to FIGS. 1, 5 and 9, the connection member 5 is substantially U-shaped, and the connection member 5 has a base 51 and two blocking walls 52 extended from two opposite sides of the base 51, wherein each of the blocking walls 52 has a distal end formed with two locking portions 521 opposite to each other. The two locking portions 521 on two side edges of the same distal end can commonly define a locking structure (i.e. an indentation), wherein the locking structure is locked in the connection groove 22 of the push rod 2 and the annular connection groove 321 of the armature 32, respectively, while the push rod 2 and the armature 32 will be thus abutted against each other. As a result, the locking function of the locking structure can carry out the tight connection between the push rod 2 and the armature 32. However, the structure of the connection member 5 disclosed in the embodiment is only one of preferred embodiments of the present invention, other possible structures of connection member capable of efficiently connecting the push rod 2 to the armature 32 also can be applied to the micro switch 100 of the present invention.

Referring now to FIGS. 1, 2, 3 and 5, when the micro switch 100 is in a switch-off status, the springs 13 of the conductive terminal assemblies 1 are disposed in the recesses 23 of the push rod 2, wherein the springs 13 are in a straight status, and the elastically conductive plates 12 are not connected to the second terminals 14. The micro switch 100 is converted from the switch-off status to a switch-on status, the push portion 21 of the push rod 2 can be directly pushed toward the electro-magnet 3. At this time, the springs 13 are slid out of the recesses 23 along the sliding inclined surfaces 25, and then abutted against the top flat surfaces 24, wherein the springs 13 will deform due to the abutment against the top flat surfaces 24 of the push rod 2. Thus, the springs 13 can pull the elastically conductive plates 12 to pivotally rotate based on the pivotal side edge of the elastically conductive plates 12 due to the deformation of the springs 13, so that the contact members 122 can be abutted against on the contact portions 1431 of the second terminals 14 for switching on the micro switch 100. Meanwhile, the springs 13 position the conductive terminal assemblies 1 on the push rod 2 due to the deformation of the springs 13 without any motion.

When an internal current of an electric component (not-shown) connected to the micro switch 100 is increased to a predetermined value due to abnormal circuit operation or manual control, the electro-magnet 3 can generate a force to push the push rod 2 to shift toward a direction away from the electro-magnet 3, so as to generate a displacement of the push rod 2. During the push rod 2 is shifted, the springs 13 of the conductive terminal assemblies 1 is slid from the sliding inclined surfaces 25 into the recesses 23. Meanwhile, the springs are returned from a curved status to the straight status. As a result, it can prevent the electric component (not-shown) connected to the micro switch 100 is damaged due to overcurrent.

As described above, the micro switch 100 of the present invention simplifies switch components into three parts, i.e. the conductive terminal assembly 1, the push rod 2 and the electro-magnet 3, while the push rod 2 can be directly pushed to switch on or off the micro switch 100, so that the structure of the micro switch 100 is simplified and the installation thereof is easier.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A micro switch, comprising:

a bracket;

at least one conductive terminal assembly substantially disposed in the bracket and having a first terminal, a conductive plate, a spring and a second terminal, one end of the spring being hooked on the first terminal, and the other end thereof being hooked on the conductive plate, one side end of the conductive plate being pivotally engaged to the first terminal;

a push rod slidably disposed in the bracket substantially and straddled by the at least one conductive terminal assembly, the push rod having a recess and a top flat portion next to the recess on a side surface thereof, wherein a side wall of the recess adjacent to the top flat portion is formed as a inclined surface; and an electro-magnet disposed in the bracket next to the at least one conductive terminal assembly and having a coil and an armature, wherein one end of the armature is connected to one end of the push rod;

wherein when being positioned in the recess, the spring is in an unforced state, so as to disconnect the conductive plate from the second terminal; alternatively, the push rod is pushed toward the electro-magnet to make the spring slide along the inclined surface to the top flat portion, and the spring is abutted against the top flat portion to deform, so as to make the conductive plate rotate toward and in contact with the second terminal.

2. The micro switch according to claim 1, wherein the first terminal has an inclined connection base, one side end of the connection base projects outward and bends vertically to form two spaced retaining portions for retaining the push rod, wherein each of the retaining portions further has a horizontal retaining portion and a vertical retaining portion, the vertical retaining portion is formed with a pivotal groove for engaging with said one side end of the conductive plate, the connection base has a hook protrusion, while the conductive plate has a hook slot, said one end of the spring is hooked on the hook protrusion, and said the other end thereof is hooked on the hook slot.

3. The micro switch according to claim 1, wherein the armature and the push rod are connected to each other by a connection member.

4. The micro switch according to claim 3, wherein the connection member is substantially U-shaped, and the connection member has a base and two blocking walls projecting upward from two opposite sides of the base, wherein a top portion of each of the blocking wall has an indentation, said one end of the armature and said one end of the push rod are partially thinned to fit into the two indentations respectively so as to abut against each other.

5. The micro switch according to claim 1, wherein the first terminal is placed on one side of the push rod, while the conductive plate and the second terminal are placed on the other opposite side of the push rod.

6. The micro switch according to claim 1, wherein the inclined surface of the recess is formed on the side wall of the recess at a longer distance away from the electro-magnet than the other side wall of the recess.

7. The micro switch according to claim 1, wherein the bracket comprises a terminal assembly receiving housing and a base, wherein the at least one conductive terminal assembly is disposed in the terminal assembly receiving housing, and the push rod is movably received in the terminal assembly receiving housing.

8. The micro switch according to claim 7, wherein the terminal assembly receiving housing comprises a lower hollow casing, a base hollow casing and an upper hollow casing successively joined together, the base has a receiving recess and a frame, wherein the electro-magnet is installed in the receiving recess, and the terminal assembly receiving housing is installed within the frame.

* * * * *